US005259477A

United States Patent [19]

Fears et al.

[11] Patent Number: 5,259,477

[45] Date of Patent: Nov. 9, 1993

[54] COLLAPSIBLE SCAFFOLD BRACKET

[75] Inventors: Clois D. Fears, 487 Cole Rd., Murrysville, Pa. 15668; Michael Urick, Monroeville; Paul V. Furlo, Greensburg, both of Pa.

[73] Assignee: Clois D. Fears, Murrysville, Pa.

[21] Appl. No.: 834,658

[22] Filed: Feb. 12, 1992

[51] Int. Cl.[5] ..... E04G 5/00

[52] U.S. Cl. ..... 182/82; 182/113; 248/236

[58] Field of Search ..... 182/82, 150, 45, 113, 182/222, 53, 55, 128, 152; 248/236, 284, 238

[56] References Cited

U.S. PATENT DOCUMENTS

| | | | |
|---|---|---|---|
| 1,043,838 | 11/1912 | Howard . | |
| 1,113,775 | 10/1914 | Gibson . | |
| 1,339,482 | 5/1920 | Sederburg . | |
| 1,586,421 | 5/1926 | Frush . | |
| 1,957,184 | 5/1934 | Smith | 248/236 |
| 2,299,323 | 10/1942 | Hetky . | |
| 3,119,590 | 1/1964 | Eriksson | 182/82 X |
| 3,134,567 | 5/1964 | Shoemaker | 182/82 X |
| 3,595,510 | 7/1971 | Hutchinson | 182/82 X |
| 3,698,680 | 10/1972 | Shoemaker | 182/82 X |
| 4,153,229 | 5/1979 | Bequette | 182/82 X |
| 4,957,185 | 9/1990 | Courchesne et al. | 182/82 X |
| 5,062,607 | 11/1991 | Kisner | 248/211 |

FOREIGN PATENT DOCUMENTS

| | | | |
|---|---|---|---|
| 2105393 | 4/1972 | France | 182/82 |
| 2378153 | 9/1978 | France | 182/82 |
| 188253 | 3/1937 | Switzerland | 248/238 |

*Primary Examiner*—Karen J. Chotkowski

*Attorney, Agent, or Firm*—James Ray & Associates

[57] ABSTRACT

A scaffold bracket is disclosed comprising a vertical beam of channel cross-section, a horizontal beam pivoted at its proximate end to a point between the ends of the vertical beam and adapted to nest within its channel cross-section, an angle bracket having a first and second end, the first end being connected to the proximate end of the vertical beam and the second end being connected to the middle of the horizontal beam whereby the horizontal beam is rigidly supported in a position substantially at right angles to the vertical beam, the vertical beam further having a hanger secured to its distal end, the hanger being adapted to engage a generally horizontal portion of a wall whereby the horizontal beam may be utilized to help support a scaffold along the wall.

20 Claims, 2 Drawing Sheets

COLLAPSIBLE SCAFFOLD BRACKET

FIELD OF THE INVENTION

The present invention relates, in general, to scaffolding and, more particularly, this invention relates to scaffold brackets for use on a wall during construction of the wall and structure proximate thereto and, more specifically, this invention relates to such a scaffold bracket which can be broken down into a single relatively flat portable unit.

BACKGROUND OF THE INVENTION

As generally well known, in the building industry, it is often necessary during construction of a wall, either freestanding or as part of a building to support workers above the ground on a scaffold so they can conveniently reach and work on parts of the wall higher than they can reach from the ground. These walls range in type from hard masonry or concrete to walls supported by spaced wood studs and sheathed with relatively fragile and/or soft materials; such as, insulating board and/or aluminum siding.

These scaffold brackets, the scaffold boards they support and ladders as well as other equipment are nomally carried from one job to another on trucks to which they are often attached by roof brackets or the like designed to carry slender, relatively light objects.

It is believed desirable to provide a scaffold bracket which can be used to adequately and safely support workers for work on all of the various types of walls which may be encountered, without damage to the wall. It is also desirable that it can be easily handled by one person and that it be collapsible into a unitary, relatively slender, flat unit readily transportable in the bed or on a roof bracket disposed on a truck or other similar carrier.

SUMMARY OF THE INVENTION

The present invention provides a collapsible scaffold bracket which is engageable with and removably securable to a wall portion of a building structure. The invented collapsible scaffold bracket includes a first elongated bracket member. Such first elongated bracket has a predetermined cross-sectional shape and a predetermined length. This first elongated bracket member is disposed in a substantially vertical position when such collapsible scaffold bracket is engaged with and secured to the wall portion of such building structure. There is a second elongated bracket member also having a predetermined cross-sectional shape and a predetermined length. The second elongated bracket member is disposed in a substantially horizontal position when such collapsible scaffold bracket is engaged with and secured to the wall portion of such building structure. A further element of the collapsible scaffold bracket is a first pivotable securement means engageable with the second elongated bracket member adjacent a first end thereof and with the first elongated bracket member at a first predetermined point intermediate a first end and a second end thereof for securing, in a pivotable manner about such first predetermined point, the first end of such second elongated bracket member to the first elongated bracket member. A third elongated bracket member having each of a predetermined cross-sectional shape and a predetermined length is provided. Such third elongated bracket member is disposed at an angle when such collapsible scaffold bracket is engaged with and secured to the wall portion of such building structure. Further provided is a second pivotable securement means engageable with such third elongated bracket member adjacent a first end thereof and with the second elongated bracket member at a second predetermined point intermediate the first end and a second end thereof for securing, in a pivotable manner about the second predetermined point, such first end of the third elongated bracket member to the second elongated bracket member. A removable securing means is engageable with a second end of the third elongated bracket member and with the first elongated bracket member at a third predetermined point located closely adjacent such second end of such first elongated bracket member for securing the second end of such third elongated bracket member to the first elongated bracket member so that such second elongated bracket member is rigidly supported in a position substantially at a right angle to the first elongated bracket member when such collapsible scaffold bracket is engaged with and secured to such wall portion of such building structure. The final essential element of the collapsible scaffold bracket is a hanger means connected to the first elongated bracket member adjacent the first end thereof for engaging a substantially horizontal portion of such wall portion of such building structure and thereby supporting such collapsible scaffold bracket during use.

OBJECTS OF THE INVENTION

It is, therefore, one of the primary objects of the present invention to provide a strong, collapsible scaffold bracket which can be readily attached to substantially any kind of wall encountered in construction.

Another object of the present invention is to provide a collapsible scaffold bracket which is relatively light in weight and can be handled by one person.

Still another object of the present invention is to provide a collapsible scaffold bracket which can be supported at various heights on a wall.

Yet another object of the present invention is to provide a collapsible scaffold bracket which can be collapsed by removal of only one fastener and which then can be folded into a slender elongated shape which can be readily transported.

A further object of the present invention is to provide a collapsible scaffold bracket which does not require any special tools to assemble or disassemble.

An additional object of the present invention is to provide a collapsible scaffold bracket which is relatively easy to manufacturer.

In addition to the various objects and advantages of the collapsible scaffold bracket discussed above, various other objects and advantages of the present invention will become more readily apparent to those persons who are skilled in the building construction art and from the following more detailed description, particularly, when such description is taken in conjunction with the attached drawings and the appended claims.

DESCRIPTION OF THE PREFERRED EMBODIMENT

Figure 3:
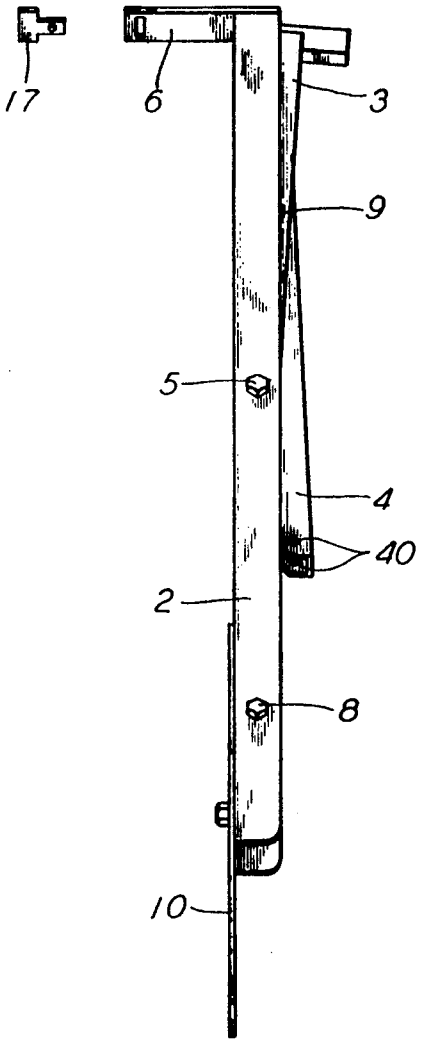
FIG. 3 illustrates the scaffold bracket in collapsed condition.

Prior to proceeding to the more detailed description of the present invention it should be noted that, for the sake of clarity, identical components having identical functions have been identified with identical reference numerals throughout the several views of the drawings.

Figure 1:
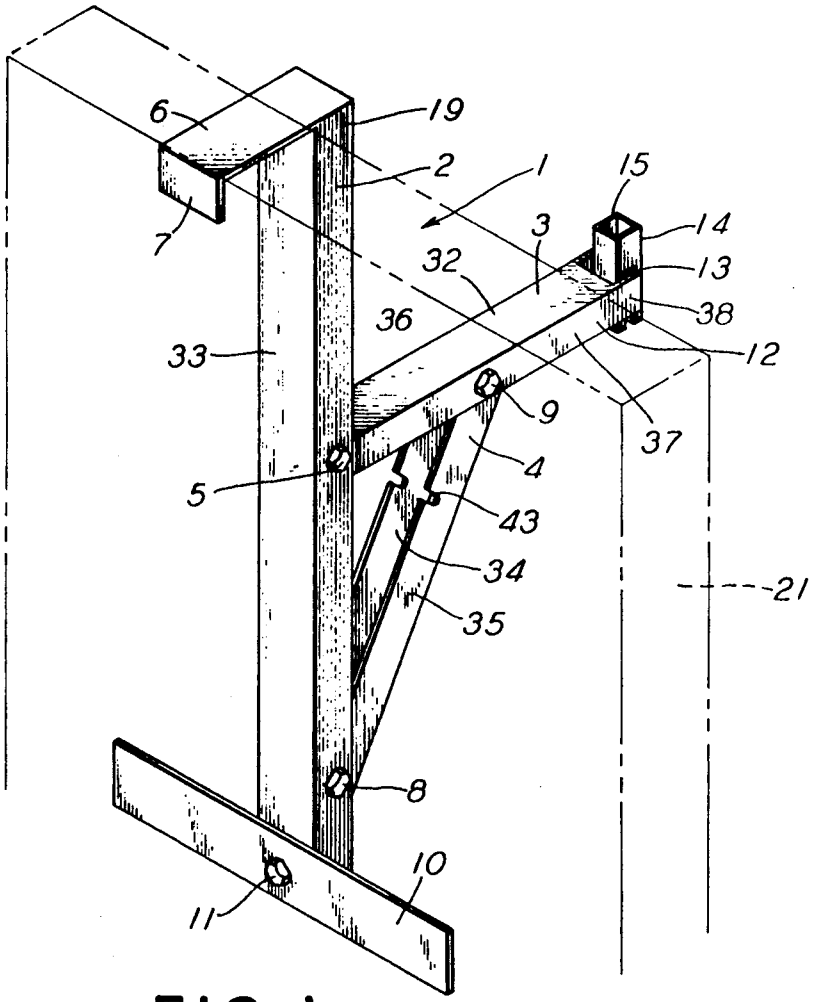
FIG. 1 is an isometric view of a presently preferred embodiment of the invention as assembled for attachment to a wall represented in phantom.

As can be seen in FIG. 1, the scaffold bracket, generally designated 1, comprises a vertical beam 2, a horizontal beam 3 and an angle bracket 4 held together by removable fasteners. In a preferred embodiment such removable fasteners are nuts and bolts, indicated generally by the numerals, 5, 8, and 9. The proximate end of the horizontal beam 3 is pivotably attached to a point intermediate the ends of the vertical beam 2 and has its middle connected to one end of angle bracket 4. A hanger 6 is welded or otherwise rigidly secured to the distal end 19 of vertical beam 2. Hanger 6 may be formed at its distal end with an integral downturned hook or retainer 7 which helps keep the scaffold bracket 1 from sliding forward off a wall 21 over which the hanger 6 is hooked. Alternatively, hanger 6 may be a flat bar, as shown in FIG. 2. As illustrated, the flat bar has a slot 16 for receiving a retainer or key member 17 of a suitable shape and size. As shown, key member 17 is of generally T-shape with a top bar 20 and a tongue 18 which can be inserted in the slot 16 in hanger 6. A pin hole 22 for receiving a pin, bolt or other form of retaining means 60 may be provided in retainer 17 for added security in holding the scaffold bracket 1 to a wall. This alternate form of hanger 6 is particularly suited for suspending the scaffold bracket 1 from a mid point on a wall as more fully described below.

Key member 17 may be provided with a hole (not shown) adjacent one of its edges for attachment to a flexible retaining means (not shown) and hanger 6 is provided with a hole (not shown) close to its distal end to receive the other end of such retaining means to reduce risk of loss of the key member 17. Such retaining means may be a wire or rope or chain. These holes are located so they do not interfere with the engagement of hanger 6 with a wall or with insertion of key member 17 in slot 16. When the hanger 6 is to be inserted through an opening or hole 48 in sheathing, shown in FIG. 2, key member 17 and the retaining means are first put through the hole 48. Then hanger 6 is inserted therethrough.

The scaffold bracket 1, of the invention, may also include a wall brace 10 attached at the lower or proximate end of vertical beam 2 by a suitable fastener 11 such as a nut and bolt. Wall brace 10 helps distribute the force of supporting the scaffold bracket 1 and scaffold over a relatively broad area of the wall to avoid damage to fragile or low compressive strength walls such as aluminum siding. In the case of stud walls in frame or veneer walls with foam or fiber insulation sheathing, the wall brace 10 will be of sufficient length to overlie one or more vertical studs or other structural members so that the sheathing does not break and adequate support is provided for the scaffold bracket 1 and scaffold. Wall brace 10 is preferably rotatable when the fastener 11 is loosened so that it can be placed in line with the longitudinal axis of vertical beam 2 to facilitate handling, storage and transportation and to permit wall brace 10 to be strategically located in relation to structural supports in the wall. Wall brace 10 may be made of the same material as is used for beams 2, 3 and bracket 4 or may be made of any other suitable material with sufficient strength to support the load of a scaffold and its load.

Figure 4:
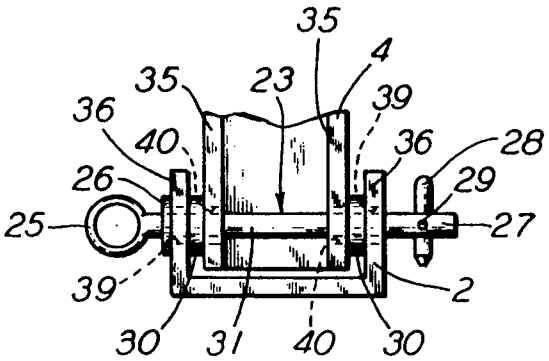
FIG. 4 is an enlarged partial view of the connection between vertical beam 2 and angle bracket 4 showing an alternative construction.

As stated above fasteners 5, 8 and 9 may be nuts and bolts of suitable strength and hardness with the nuts being preferably of the type which resist inadvertent removal. Wing nuts may be used to facilitate assembly and disassembly by hand. As seen in FIG. 4 the fasteners 5, 8 and 9 can be eye bolts 23. The eye bolt has a clevis end 27 in which is pivoted a locking or cross-pin 28 pivotable about a fixed pin 29 permanently secured to the eye bolt. Eye bolt 23 may have a shank 31, an eye 25, an annular shoulder 26 of a diameter greater than the diameter of the shank 31 and cross pin 28. Flanges 36 are provided with bores 39 and flanges 35 are provided with bores 40 to rotatably receive the shank of a fastener as shown in FIG. 4. Similar provisions are made to receive fasteners 5 and 9 for the connections of horizontal beam 3 at its proximate end with vertical beam 2 and at its middle with angle bracket 4.

Vertical beam 2, horizontal beam 3 and angle bracket 4 are, in the presently preferred embodiment of the invention, each constructed of channel stock to resist bending. Alternatively, a heavy gauge flat sheet metal stock may be used instead and bent into the desired channel shape. Material of about one sixteenth inch thickness may be used. In any event the material must be strong and rigid enough for the desired use. The channel or web 32 of horizontal beam 3 is slightly narrower than the channel or web 33 of vertical beam 2 so that the flanges 37 of horizontal beam 3 will rotate snugly within flanges 36 of vertical beam 2 when they are assembled with fastener 5. The channel or web 34 of angle bracket 4, in turn, is slightly narrower than the channel 32 of horizontal beam 3 so that the flanges 35 of angle bracket 4 will rotate snugly within flanges 37 of horizontal beam 3. This means that there will be a space approximately equal to the thickness of flanges 37 between the flanges 35 and the flanges 36 where the angle bracket 4 is attached to the lower or proximate end of vertical beam 2. This space may be eliminated by inserting washers or spacers 30 between the flanges 35 and 36 over the shank of the bolt used to attach the bracket 4 to the beam 2 as shown in FIG. 4.

Horizontal beam 3 may also be provided with a safety rail bracket 14 as seen in FIG. 1. A portion of channel 32 at the distal end of horizontal beam 3 is removed leaving extensions 38 of flanges 37. Safety rail bracket 14 is attached to extensions 38 by plates 13, which may be welded or otherwise rigidly secured to bracket 14 and extensions 38. Bracket 14 is provided with a socket 15 or other suitable means for matingly receiving a support member or connecting means of a safety rail, not shown. Bracket 14 also serves to keep a plank or other scaffold means from sliding off the distal end of horizontal beam 3.

To collapse the scaffold bracket 1, for handling, storage or transportation it is necessary to remove only one fastener, for example fastener 8. This will permit horizontal beam 3 to be pivoted about fastener 5 and partially nested in the channel of vertical beam 2 until beam 3 abuts the distal end of vertical beam 2. Angle bracket 4 can then be pivoted about fastener 9 to a position abutting and partially nesting in beams 2 and 3. Notches 43 are provided to facilitate nesting of angle bracket 4 into vertical beam 2 and horizontal beam 3. These notches located and sized to fit over the shank of fastener 5 to allow angle bracket 4 to be pivoted further into beams 2 and 3. Wall brace 10 is then rotated to be in line longitudinally with vertical beam 2 to present a narrow compact package. Fastener 8 is replaced in the holes 39 provided in beam 2 for storage and retention. FIG. 3 shows the scaffold bracket 1 in a collapsed state.

It will be noted that the scaffold bracket 1 of this invention can be conditioned for folding by removing either fastener 5 or fastener 9 instead of fastener 8 as previously described. As can be seen the members 2, 3 and 4 would still fold into a compact, narrow package for storage or transportation.

Use of the scaffold bracket 1 will now be described, assuming that it is in the collapsed position with fastener 8 having been removed, the bracket folded and fastener 8 replaced in the bores 39 in vertical beam 2 for storage. Fastener 8 is first removed, then bracket 4 and horizontal beam 3 are pivoted downward about fasteners 9 and 5 respectively until the bolt holes 39 and 40 through the flanges 35 and 36 are in alignment and fastener 8 can be inserted therethrough and locked in place. At this time horizontal beam 3 will be substantially at right angles to vertical beam 2. The distal end of vertical beam 2 is raised so that hanger 6 can be engaged with a part of the wall capable of supporting a scaffold and its load. This may be the top of the wall if it is masonry or the top plate of a frame wall. If necessary wall brace 10 is rotated to a position where it will be supported by a structural support member in the wall. In the form of the invention show in FIG. 2, the key member 17 is inserted in the slot 16 and locked in place with a pin, bolt 60 or other retaining means. At this point safety rail bracket 14 will be in position to receive a safety rail support. At least one or more scaffold bracket is mounted on the wall in similar fashion and suitable planks or other scaffolding put in place. Safety rail supports and rails can now be attached and the scaffold is ready for use. The entire process is reversed to disassemble the scaffold for storage or transportation.

Figure 2B:
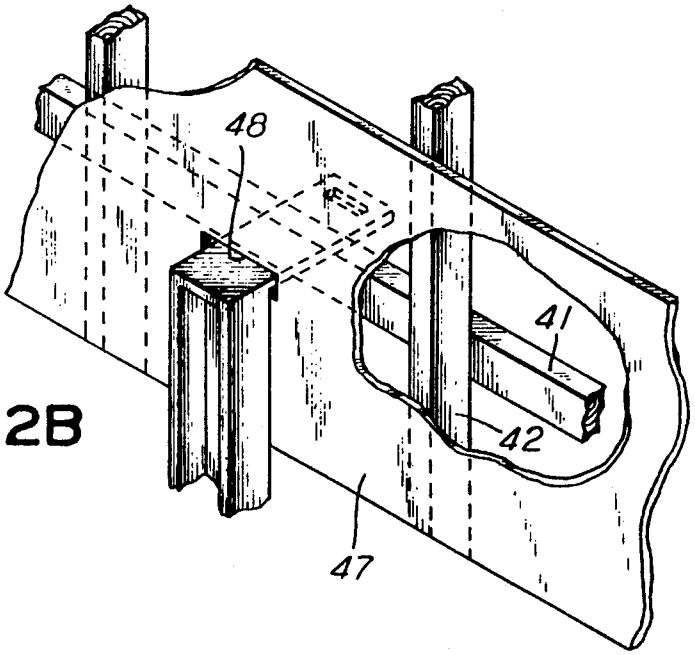
FIGS. 2A and 2B show a partial view of the present invention employing an alternative form of hanger for supporting the bracket on a wall, FIG. 2A showing an open stud wall, FIG. 2B showing a sheathed stud wall with a portion of the sheathing broken away for clarity.
Figure 2A:
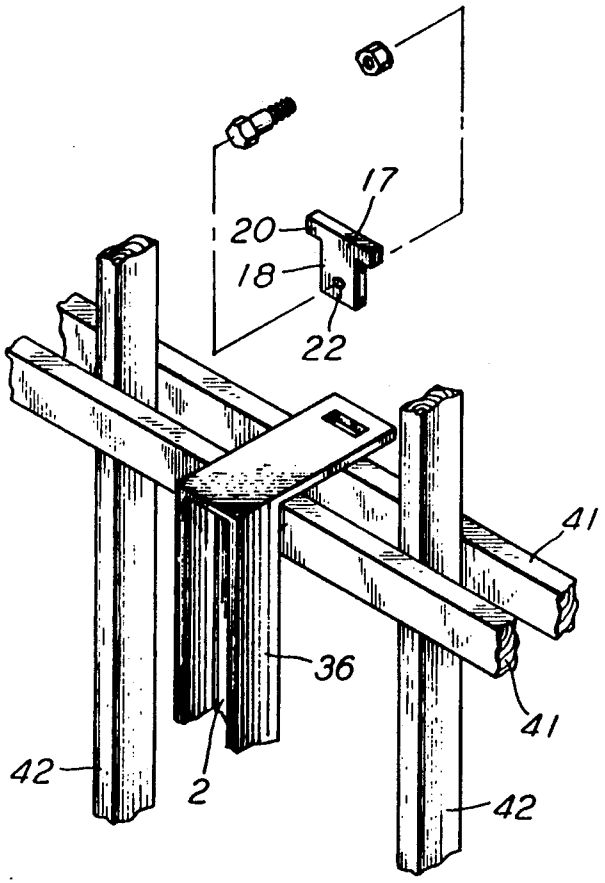

If the scaffold bracket 1 is to be used on the part of a frame wall where the hanger will not reach the top of the wall, and the wall has been sheathed, the header of FIG. 2 is preferred. A temporary support 41 is rigidly secured to studs 42 as seen in FIG. 2B, a small opening 48 is made in the sheathing so that the hanger 6 can be put through the opening 48, the hanger 6 is hung over the temporary support 41 and the key member 17 put in place to help retain the hanger 6 on support 41. It is obvious that in cases where one or both sides of a hollow wall have been sheathed or finished, the support 41 can be placed over the sheathing or finished material and fastened to studs 42. Hanger 6 is inserted through holes 48 in the sheathing or finish material and hung on supports 41. Key member 17 is inserted in slot 16 as described above. If the wall has not been sheathed or finished, supports 41 can be attached on either or both sides of the wall as seen in FIG. 2A at a point selected so that the horizontal beam 3 will support a plank or scaffold at the desired height. The supports 41 are detached when no longer needed to support scaffold bracket 1.

In a specific example of a preferred embodiment of the invention the vertical beam 2, the horizontal beam 3 and the angle bracket 4 all may be constructed of 1/16 inch thick steel channel. For the beam 2 the channel may have a web width of about 3½ inches and flange depth of about 1½ inches. The overall length of the vertical beam 2 may be about 48 inches. Horizontal beam 3 may be about 24 inches long, have a web width of about 3⅜ inches and a flange depth of about 1½ inches. Angle bracket 4 will have a web width of about 3¼ inches and a flange depth of about 1½ inches. The distance between channel 33 and the adjacent side of hook 7 or of key member 17 may be approximately 6 inches but can be greater or smaller if it is intended for use with walls of greater or less thickness. The width of hanger 6 and hook 7 may be approximately equal to the distance between the outer surfaces of the flanges of vertical beam 2. Wall brace 10 may be made of ⅛ inch thick steel plate about 3 inches wide and 24 inches long.

While specific embodiments of the invention have been shown and described it is obvious that many variations and adjustments may be made to the specific arrangements and dimensions shown without departing from the scope of the invention as defined by the following claims.

We claim:

1. A collapsible scaffold bracket engageable with and removably securable to a wall portion of a building structure, said collapsible scaffold bracket comprising:

(a) a first elongated bracket member having each of a first predetermined cross-sectional shape and a first predetermined length, said first elongated bracket member being disposed in a substantially vertical position when said collapsible scaffold bracket is engaged with and secured to such wall portion of such building structure;

(b) a second elongated bracket member having each of a second predetermined cross-sectional shape and a second predetermined length, said second elongated bracket member being disposed in a substantially horizontal position when said collapsible scaffold bracket is engaged with and secured to such wall portion of such building structure;

(c) a first pivotal securement means engageable with said second elongated bracket member adjacent a first end thereof and with said first elongated bracket member at a first predetermined point intermediate a first end and a second end thereof for securing, in a pivotal manner about said first predetermined point, said first end of said second elongated bracket member to said first elongated bracket member;

(d) a third elongated bracket member having each of a third predetermined cross-sectional shape and a third predetermined length, said first and said second and said third predetermined cross-sectional shape being substantially identical and said first predetermined length of said first elongated bracket member being greater than said second predetermined length of said second elongated bracket member and said third predetermined length of said third elongated bracket member, said third elongated bracket member being disposed at an angle when said collapsible scaffold bracket is engaged with and secured to such wall portion of such building structure;

(e) a second pivotal securement means engageable with said third elongated bracket member adjacent a first end thereof and with said second elongated bracket member at a second predetermined point intermediate said first end and a second end thereof for securing, in a pivotal manner about said second predetermined point, said first end of said third elongated bracket member to said second elongated bracket member;

(f) a removable securing means engageable with a second end of said third elongated bracket member and with said first elongated bracket member at a third predetermined point located closely adjacent said second end of said first elongated bracket member for securing said second end of said third elongated bracket member to said first elongated bracket member so that said second elongated bracket member is rigidly supported in a position substantially at a right angle to said first elongated bracket member when said collapsible scaffold bracket is engaged with and secured to such wall portion of such building structure; and (g) A hanger means connected to said first elongated bracket member adjacent said first end thereof for engaging a substantially horizontal portion of such wall portion of such building structure and thereby supporting said collapsible scaffold bracket.

2. A collapsible scaffold bracket, according to claim 1, wherein said first predetermined cross-sectional shape of said first elongated bracket member is a generally U-shaped channel.

3. A collapsible scaffold bracket, according to claim 2, wherein said second predetermined cross-sectional shape of said second elongated bracket member is generally a U-shaped channel and is sized such that it will nest in said generally U-shaped channel of said first elongated bracket member when said collapsible scaffold bracket is in a collapsed condition.

4. A collapsible scaffold bracket, according to claim 3, wherein said third predetermined cross-sectional shape of said third elongated bracket member is a generally U-shaped channel and is sized such that it will nest in said generally U-shaped channel of said second elongated bracket member when said collapsible scaffold bracket is in a collapsed position.

5. A collapsible scaffold bracket, according to claim 1, wherein said first pivotable securement means is a first bolt.

6. A collapsible scaffold bracket, according to claim 5, wherein said second pivotable securement means is a second bolt.

7. A collapsible scaffold bracket, according to claim 6, wherein each of said first bolt and said second bolt include a lock-nut.

8. A collapsible scaffold bracket, according to claim 1, wherein said removable securing means ia third bolt.

9. A collapsible scaffold bracket, according to claim 8, wherein said third both includes a wing nut.

10. A collapsible scaffold bracket, according to claim 1, wherein said hanger means includes a hook portion engageable with such horizontal portion of such wall portion of such building structure, an inner face of said hook portion being disposed substantially parallel to at least a portion of a confronting face of said first elongated bracket member.

11. A collapsible scaffold bracket, according to claim 1, wherein said hanger means includes a key member engageable in a slot formed in said hanger means, an inner surface of said key member being engageable with such horizontal portion of such wall portion of such building structure.

12. A collapsible scaffold bracket, according to claim 11, wherein said key member is T-shaped.

13. A collapsible scaffold bracket, according to claim 12, wherein said key member includes an aperture formed therethrough and said hanger means further includes a retaining member engageable in said aperture to retain said key member in said slot.

14. A collapsible scaffold bracket, according to claim 1, wherein said collapsible scaffold bracket further includes a support member disposed at said second end of said second elongated bracket member to enable a safety rail to be secured thereto.

15. A collapsible scaffold bracket, according to claim 1, wherein said collapsible scaffold bracket further includes a wall brace member secured adjacent said second end of said first elongated bracket member, said wall brace member having a size at least sufficient to contact at least one structural member of such wall portion of such building structure.

16. A collapsible scaffold bracket, according to claim 15, wherein said size of said wall member brace is at least sufficient to contact two structural members of such wall portion of such building structure.

17. A collapsible scaffold bracket, according to claim 16, wherein said wall brace member is pivotable to a plane parallel to a longitudinal axis of said first elongated bracket member.

18. A scaffold bracket comprising a vertical beam of channel cross-section, a horizontal beam pivoted at its proximate end to a point between the ends of said vertical beam and adapted to nest within said channel cross-section, an angle bracket having a first and second end, said first end being connected to the proximate end of said vertical beam and said second end being connected to a point near the middle of said horizontal beam, whereby said horizontal beam is rigidly supported in a position substantially at right angles to said vertical beam, said vertical beam having a first predetermined length which is greater a second predetermined length of said horizontal beam and a third predetermined length of said angle bracket, said vertical beam further having a hanger secured to its distal end, said hanger being adapted to engage a horizontal portion of a wall whereby said horizontal beam may be utilized to help support a scaffold along such wall.

19. A scaffold bracket, according to claim 18, wherein said horizontal beam and said angle bracket are also of channel cross-section and said angle bracket is adapted to nest within said horizontal beam when said horizontal beam is nested within said vertical beam.

20. A scaffold bracket, according to claim 18, the distal end of said horizontal beam having a support for a safety rail.

* * * * *

UNITED STATES PATENT AND TRADEMARK OFFICE

CERTIFICATE OF CORRECTION

PATENT NO. : 5,259,477

DATED : November 9, 1993

INVENTOR(S) : Fears, et. al.

It is certified that error appears in the above-indentified patent and that said Letters Patent is hereby corrected as shown below:

Column 1, line 14, after As, insert --is--
Column 1, line 16, delete "freestanding" and insert --free-standing--
Column 5, line 5, after notches, insert --43 are--
Column 7, line 55, delete "ia" and insert --is a--

Signed and Sealed this

Fifteenth Day of March, 1994

*Attest:*

*Attesting Officer*

BRUCE LEHMAN

*Commissioner of Patents and Trademarks*